United States Patent [19]

Naka

[11] 3,973,677

[45] Aug. 10, 1976

[54] CLOTHES DRYING DEVICE

[76] Inventor: Hiromitsu Naka, No. 39 Daza, Shin, Yashio, Saitama, Japan

[22] Filed: Oct. 3, 1974

[21] Appl. No.: 511,730

[52] U.S. Cl. ..... 211/97; 248/278

[51] Int. Cl.[2] ..... A47F 5/08

[58] Field of Search ..... 211/97, 96, 99, 101, 211/100, 171; 248/278, 291, 284, 485, 487, 294, 478, 477, 415, 418, 145

[56] References Cited

UNITED STATES PATENTS

| | | | |
|---|---|---|---|
| 648,234 | 4/1900 | Brown | 211/97 X |
| 977,921 | 12/1910 | Zizinia | 211/99 |
| 1,131,699 | 3/1915 | Hoecker et al. | 211/96 X |
| 1,518,054 | 12/1924 | Dzurak | 211/13 |
| 1,572,845 | 2/1926 | Efford et al. | 211/96 |
| 1,697,866 | 1/1929 | Hansen | 211/96 X |
| 1,892,687 | 1/1933 | Teufel | 211/99 |
| 2,242,090 | 5/1941 | Schilling | 211/96 |
| 2,523,118 | 9/1950 | Jones | 248/278 |
| 2,985,312 | 5/1961 | Pantek et al. | 211/96 |

FOREIGN PATENTS OR APPLICATIONS

| | | | |
|---|---|---|---|
| 165,573 | 7/1921 | United Kingdom | 248/487 |

*Primary Examiner*—Roy D. Frazier
*Assistant Examiner*—Robert W. Gibson, Jr.
*Attorney, Agent, or Firm*—Wenderoth, Lind & Ponack

[57] ABSTRACT

A cantilever-type clothes drying device comprising an anchoring means adapted to be secured to a window, a terrace hand-rail or wall and a support arm pivoted to the anchoring means for rotational movement in both the horizontal and vertical directions with respect to the anchoring means between operative and inoperative positions.

4 Claims, 12 Drawing Figures

CLOTHES DRYING DEVICE

This invention relates to a clothes drying device to be secured to a window, terrace hand-rail or wall and more particularly, to a cantilever-type clothes drying device.

One object of the present invention is to provide a cantilever-type clothes drying device adapted to be secured to a window, terrace hand-rail or wall in which a support arm is pivoted to an anchoring means in such a manner that the support arm is rotated between operative and inoperative positions and is easily reorientated.

Another object of the present invention is to provide a cantilever-type clothes drying device in which a support arm can be moved between operative and inoperative positions in a quite simple manner and can be also selectively locked in the operative and inoperative positions.

Another object of the present invention is to provide a cantilever-type clothes drying device in which, when the device is used, a support arm is positively locked in its operative position under the weight of articles to be hung thereon for drying.

Another object of the present invention is to provide a cantilever-type clothes drying device which is adapted to be out of the way when the device is not used.

Another object of the present invention is to provide a cantilever-type clothes drying device in which a support arm can be reorientated with respect to an anchoring member depending upon the direction of the sun rays and/or the wind.

Another object of the present invention is to provide a cantilever-type clothes drying device which resists corrosion is light in weight and high in strength.

Another object of the present invention is to provide a cantilever-type clothes drying device which can be conveniently employed in conjunction with clothes rods and/or lines.

Another object of the present invention is to provide a cantilever-type clothes drying device which can be simply secured to a window, terrace hand-rail or wall.

The above and other objects and attendant advantages of the present invention will be more readily apparent to those skilled in the art from a reading of the following description in conjunction with the accompanying drawings which show preferred embodiments of the invention for illustration purpose only, but not for limiting the scope of the same in any way.

Figure 4:
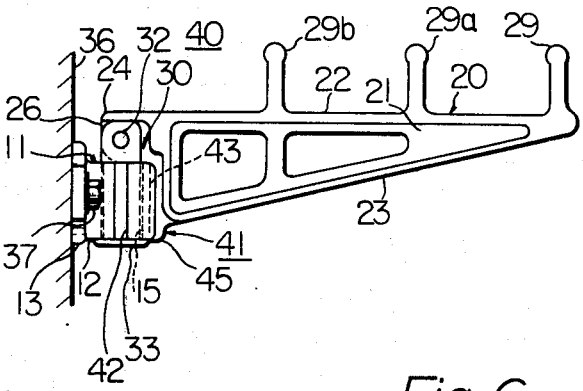
FIG. 4 is a side elevational view of a second or modified embodiment of clothes drying device constructed in accordance with the present invention showing the device as being installed on a wall of a building and in its operative position.
Figure 5:
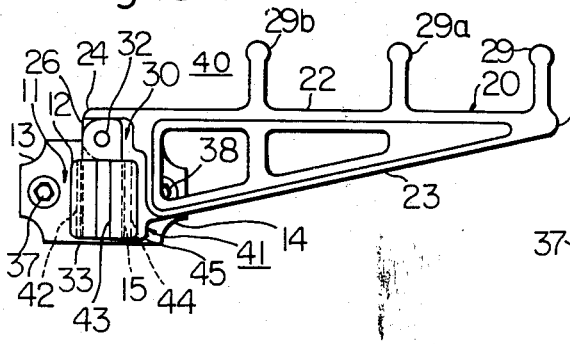
FIG. 5 is similar to FIG. 4, but shows the clothes drying device in its inoperative position.
Figure 6:
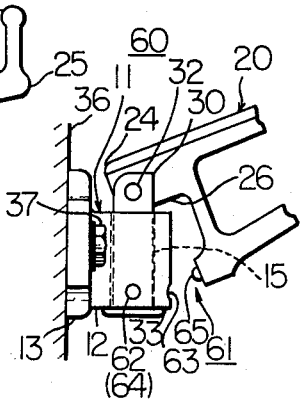
Figure 7:
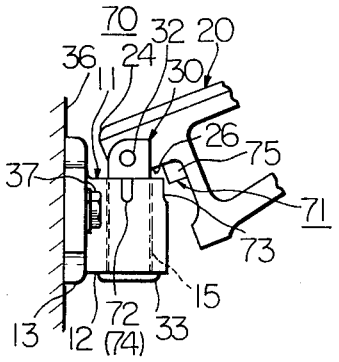
Figure 8:
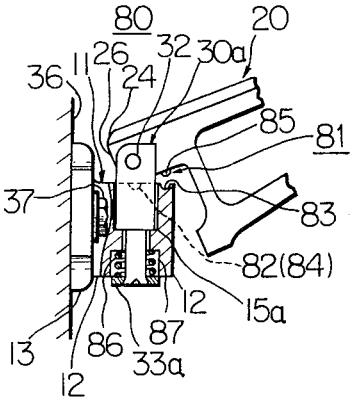
Figure 9:
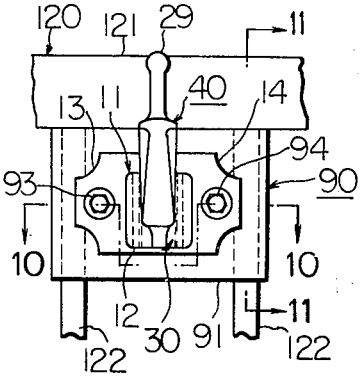
Figure 10:
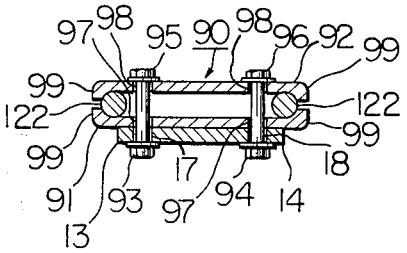
Figure 11:
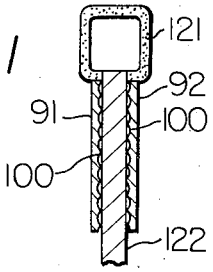
Figure 12:
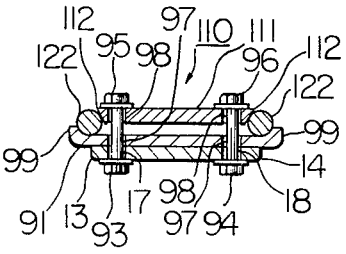

FIGS. 6 through 8 inclusive are fragmentary side elevational views of further modified embodiments of clothes drying device constructed in accordance with the present invention with portion thereof broken away;

FIg. 9 is a front elevational view of the embodiment of FIGS. 4 and 5 showing the same as being installed on the hand-rail of a terrace;

FIG. 10 is a cross-sectional view taken along substantially the line 10—10 of FIG. 9 showing the attachment means as shown in FIG. 9;

FIG. 11 is a fragmentary view in partial section taken along substantially the line 11—11 of FIG. 9; and FIG. 12 is a cross-sectional view similar to FIG. 10, but shows a modified attachment means.

Figure 1:
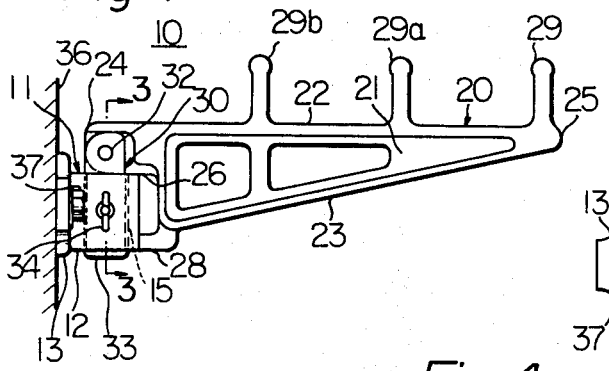
FIG. 1 is a side elevational view of a first or preferred embodiment of clothes drying device constructed in accordance with the present invention showing the device as being installed on a wall of a building and in its operative position.
Figure 2:
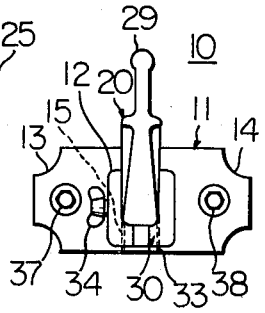
FIG. 2 is a front elevational view of said embodiment of FIG. 1.
Figure 3:
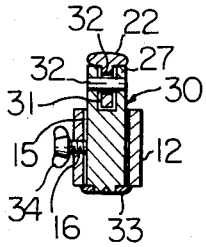
FIG. 3 is a cross-sectional view taken along substantially the line 3—3 of FIG. 1.

Referring to the accompanying drawings and more particularly, to FIG. 1 through 3 inclusive thereof, a first or preferred embodiment of the cantilever-type clothes drying device of the invention is generally shown by reference numeral 10. The clothes drying device 10 is made of aluminium or aluminium alloy and is shown as being installed on a building wall 36 by means of bolts 37 and 38.

The clothes drying device 10 generally comprises an anchoring member 11, a support arm 20 which is movable relative to the anchoring member and on which a clothes rod or clothes line (not shown) is adapted to be supported and connecting means for connecting the support arm 20 to the anchoring member 11 in such a manner that the support arm 20 is held in its horizontal or operative position and can be also rotated in horizon with respect to the anchoring member 11.

The anchoring member 11 comprises a center cylindrical main body 12 and a pair of flanges 13 and 14 integrally formed with the main body and projecting outwardly from the opposite ends of the main body. The main body 12 is further formed with a vertical hole 15 in the center thereof for receiving an upright arm support shaft 30 therein. The main body 12 is further provided with a transverse threaded hole 16 intersecting the hole 15 for receiving a thumbscrew 34 which is adapted to arrest the rotational movement of the upright support shaft 30 and more particularly, the support arm 20 relative to the anchoring member 11 and more even particularly, the main body 12.

The flanges 13 and 14 are formed with bolt holes (not shown) for receiving the bolts 37 and 38 which secure the clothes drying device 10 to the wall 36.

The support arm 20 comprises a main body 21 having an I-shaped cross section. The main body 21 has a horizontal upper surface 22 and a bottom surface 23 which slopes upwardly from the base 24 toward the forward end 25 of the main body 21 so as to impart an elongated triangular configuration to the support arm as seen in the side elevation.

The base 24 of the main body 21 has its lower web portion partially cut away or removed while the remaining or upper web portion 26 thereof is formed with a transverse hole 27 through which a transverse stub shaft 32 extends to pivot the support arm 20 to the arm support shaft 30 for vertical movement with respect to the shaft 30.

The lower end of the lower web portion of the base 24 of the main body 21 below the cut away is formed with a rearwardly extending projection 28 which is adapted to abut against the outer surface of the main body 12 of the anchoring member 11 at the lower end portion thereof so as to arrest the downward pivotal movement of the support arm 20 about the transverse shaft 32 and to thereby hold the support arm horizontal.

The upper web portion 26 of the base 25 is positioned within the vertical hole 15 in the anchoring member main body 12 and is fitted in a notch 31 formed in the upper end of the arm support shaft 30 which extends upwardly from the upper end face of the main body 12. The transverse hole 27 in the upper web portion 26 of the support arm base 24 receives the stub shaft 32 which extends transversely of the notch 31 and is secured to the upper end of the arm support shaft 32 so as to pivot the support arm 20 to the support shaft 30 for vertical pivotal movement with respect to the latter.

The lower end of the support shaft 30 has an annular stop 33 secured thereto so as to limit the upward movement of the arm support shaft 30 relative to the anchoring member main body 12.

The upper surface 22 of the support arm 20 is provided with a plurality of suitably spaced upright hooks 29, 29*a* and 29*b* which hold clothes-rods therebetween or to which clothes-lines are bound.

As can be appreciated from the foregoing description of the first or preferred embodiment of the invention, the connecting means for connecting the support arm 20 to the anchoring member 11 comprises the upright arm support shaft 30 received in the vertical hole 15 in the anchoring member main body 12, the transverse stub shaft 32 on which the upper end of the upright shaft 30 projecting upwardly of the upper end face of the main body 12 and the upper web portion 26 of the base 24 of the support arm main body 21 are journalled and the projection 28 at the bottom of the base 24 of the support arm main body 21 adapted to abut against the outer surface of the anchoring member main body 12 in the lower portion thereof.

Thus, the support arm 20 of the clothes drying device 10 is allowed to rotate horizontally together with the upright arm support shaft 30 and to rotate vertically about the transverse stub shaft 32 relative to the support shaft 30, respectively.

Now description will be made of the installation of the clothes drying device and of the use of the device. First of all, two clothes drying devices 10 are secured to the wall 26 in a desired or suitably spaced relationship by means of bolts 37 and 38 which extend through the holes in the anchoring member main body 12. Thereafter, when the thumbscrew 34 is left in its untighted position, since the upright arm support shaft 30 is freely movable within the vertical hole 15 in the anchoring member main body 12, the support arm 20 secured to the arm support shaft 30 is allowed to rotate horizontally relative to the anchoring member 11. Since the support arm is mounted for vertical rotation about the transverse stub 32 when the thumbscrew 34 is left in its untightened or unloosened position, the support arm 20 is allowed to rotate vertically with respect to the anchoring member 11 for a predetermined range.

Thus, in use, the thumbscrew 34 is first loosened and the support arm 20 is then so positioned that the upper surface 22 of the main body 21 will extend at right angles to the wall 36. Thereafter, the thumbscrew 34 is tightened to secure the support arm 20 to the anchoring member 11 against movement. Then, a clothes rod is placed on the two clothes drying devices 10 with the opposite ends of the rod positioned between hooks 29, 29*a* and 29*a*, 29*b*, respectively. When a clothes line or lines are employed in conjunction with the devices 10, one end of the lines is bound to the hooks 29, 29*a* and 29*b* of one of the devices 10, respectively and the other ends of the lines are bound to the corresponding hooks on the other device 10, respectively, to hold the lines between the devices under tension.

When not used, the thumbscrew 34 associated with each of the devices 10 is loosened and the support arm 20 of each device 10 is rotated about the transverse stub shaft 32 until the upper surface 22 of the support arm 20 extends substantially parallel to the wall 36 in which case the arm is inoperative. Thereafter, the thumbscrew 34 is re-tightened to secure the support arm 20 to the anchoring member 11 associated therewith so as to hold the arm in its inoperative position. Thus, when not used, the support arm 20 will not be in the way.

In FIGS. 4 and 5, a modified embodiment of clothes drying device of the invention is generally shown by reference numeral 40. The clothes drying device 40 is substantially similar to the device 10 of FIGS. 1 through 3 inclusive except that the locking means which locks the support arm to the anchoring member in the operative and inoperative positions, respectively is different from the corresponding means of the first embodiment the remaining parts of the device 40 are identical with or similar to the corresponding parts of the device 10. Thus, the identical or similar parts are assigned the same numerals thereto and a description of these parts will be omitted herein.

The locking means 41 of the modified clothes drying device comprises three suitably spaced vertical grooves 42, 43 and 44 formed in the periphery of the cylindrical main body 12 of the anchoring member 11 and an engaging tongue 45 formed at the base 24 of the support arm main body 21 for selective engagement with the vertical grooves.

The engaging tongue 45 is integrally formed with and extends from the lower web portion which is partially cut away and positioned below the upper web portion 26 in the support arm main body 21.

The operation of the cantilever-type clothes drying device 40 after the installation thereof on the wall 36 is simpler than that in which the device 10 is operated.

When the clothes drying device 40 is used, the support arm 20 is rotated upwardly about the transverse stub shaft 32 (see FIGS. 6 through 8) from the inoperative or locked position as shown in FIG. 5 to disengage the tongue 45 from the groove 44. The support arm 20 is then rotated horizontally and leftwardly as seen in FIG. 5 about the vertical support shaft 30 while maintaining the arm in its raised position as shown in FIGS. 6 through 8 to a position in which the tongue 45 faces the next vertical groove 43 normal to the wall 36. Thereafter, the support arm 20 is rotated downwardly about the transverse shaft 32 until the tongue 45 engages the groove 43 to thereby lock the support arm 20 to the anchoring member 11 with the upper surface 22 lying in horizon. Thereafter, the clothes drying device 40 is used in the same manner as described in connection with the device 10. When it is desired to return the clothes drying device 40 to its inoperative position, the procedure followed when the device is moved from its inoperative position to the operative position is merely reversed.

The manipulation of the clothes drying device 40 from the inoperative position to the operative position and vice versa is quite simple. In use, the engagement between the engaging tongue 45 and the vertical groove 43 can be made more positive by the weight of the clothes rods and/or lines and thereby prevent the support arm from rocking leftwards and rightwards as the support arm 20 is locked to the anchoring member 11. Thus, in the clothes drying device 40, the clothes rods and/or clothes lines are effectively prevented from falling off the device which would otherwise occur due to the leftwards and rightwards rocking of the support arm 20.

FIGS. 6 through 8 show further modified embodiments of clothes drying device of the invention and these embodiments are assigned reference numerals 60, 70 and 80, respectively. The clothes drying devices 60, 70 and 80 are substantially similar to the clothes drying device 40 except that they employ modified locking means which are different from that employed in the device 40 for locking the support arm to the anchoring member in its operative and inoperative positions. The remaining parts of these modified embodiments which are identical with the corresponding parts of the device 40 bear the same numerals and description of these corresponding parts will be omitted herein.

The locking means 60 in the clothes drying device of FIG. 6 comprises three recesses 62, 63 and 64 formed in the periphery of the lower portion of the cylindrical main body 12 of the anchoring member 11 in a suitably spaced relationship and a semi-spherical projection 65 is provided at the end face of the lower portion of the base 24 of the support arm main body 21 for selective engagement with the recesses.

The projection 65 is adapted to engage one of the recesses 62, 63 and 64 at one time and projects rearwardly from the base 24 below the cut away in the lower web portion of the support arm main body 21.

Thus, when the projection 65 engages any one of the recesses 62, 63 and 64 in the anchoring member main body 12, the support arm 20 is locked to the anchoring member 11 in its operative or inoperative position. The manipulation of the support arm 20 for movement relative to the anchoring member 11 is the same as that for the corresponding part in the clothes drying device 40 of FIG. 4.

The clothes drying device 70 of FIG. 7 employs a further modified locking means 71 which comprises three notches or recesses 72, 73 and 74 formed in the outer periphery of the upper portion of the cylindrical main body 12 of the anchoring member 11 in a suitably spaced relation and the engaging tongue 75 formed at the rear face of the base 24 of the main body of the support arm 20 for selective engagement with the recesses.

The locking of the support arm 20 in its operative and inoperative positions and the pivotal movement of the support arm with respect to the anchoring member 11 in this clothes drying device 70 are effected in the same manner as the corresponding part of the clothes drying device 60.

The clothes drying device 80 of FIG. 8 employs a further modified locking means 81 which comprises three semi-spherical recesses 82, 83 and 84 formed in the upper end face of the cylindrical main body 12 of the anchoring member 11 adjacent to the periphery thereof in a suitably spaced relationship and the engaging tongue 85 formed at the base 24 of the support arm main body 21 for selectively engaging the recesses.

An engaging tongue 85 projects downwardly from the bottom of the upper web portion 26 of the base 24 for engaging one of the tress recesses 82, and 83 and 84 at one time and the engagement between the engaging tongue 85 and one of the recesses 82, 83 and 84 is effected when the support arm 20 is pivoted about the transverse stub shaft 32 until the upper surface 22 of the support arm 20 is positioned substantially normal to the wall 36.

Although not shown, the semi-spherical recesses 82, 83 and 84 may be replaced by three radial grooves formed in the corresponding positions and similarly, the semi-spherical engaging tongue 85 may be also replaced by a different engaging tongue projecting downwardly from the bottom of the upper web portion 26 of the support arm base 24 without departing from the scope of the invention.

Furthermore, the locking means 81 includes a biasing means 86 which normally urges the bottom of the upper web portion 26 of the support arm base 24 against the upper end face of the anchoring member main body 12 through the upright support arm **30*a* so that the locking function of the locking means 81** will be more positive.

The biasing means 86 comprises a coiled spring coaxially disposed about the reduced diameter lower end of the support shaft **30*a* and is positioned between a spring chamber 87 formed by coaxially enlarging the lower end of the stepped vertical hole 15*a* in the anchoring member main body 12 and a spring stop in the form of an annular plate 33*a* secured to the lower end of the support shaft 30*a***.

The manipulation of the support arm 20 with respect to the anchoring member 11 is the same as that in the clothes drying device 60 of FIG. 6.

And in order to enhance the locking function of the locking means 61, 71 and 81 and hold the support arm 20 against rocking under the influence of wind, magnets, a magnet and steel or magnetic material may be provided on or embedded in the adjacent opposite areas of the anchoring member 11 and support arm 20.

FIGS. 9 through 11 inclusive show an application of the clothes drying device 40 as shown in FIGS. 4 and 5 wherein the device 40 is secured to a hand rail 120 of a terrace by means of an attachment 90.

The attachment 90 has a pair of seat plates 91, 92 bridging between and embracing bars 122, fastening bolts 93, 94 extending through the seat plates and nuts 95, 96 through which the bolts also extend.

The seat plates 91 and 92 are provided with bolt holes 97 and 98 which are aligned with bolt holes 17 and 18 in the flanges 13 and 14, respectively. Thus, when the clothes drying device 40 is to be secured to the terrace hand rail 120, the anchoring member 11 and the seat plates 91 and 92 are positioned bridging and embracing the bars 122 and 122 adjacent to the top beam 121 of the handrail 120 as shown in FIG. 10, then, the fastening bolts 93 and 94 are passed through the aligned bolt holes 17, 18 and 97, 98 in the anchoring member 11 and seat plates 91, 92 and finally, the nuts 95, 96 are tightened on the bolts 93, 94.

The seat plates 91 and 92 are provided at the opposite ends with inwardly bent flanges 99 so that the seat plates 91 and 92 are prevented from coming off the bars 122.

Furthermore, so that the seat plates 91 and 92 can more positively embrace the bars 122 and in turn, the bars can be more positively held in position, the inner surfaces of the seat plates where the plates contact the bars 122 are formed with serrations 100 as shown in FIG. 11.

FIG. 12 shows a modification of the attachment means 90 as shown in FIGS. 9 through 11. In the attachment means 110 of FIG. 12, the seat plate 92 of FIGS. 9 through 11 is replaced by a modified seat plate 111 which is provided at the opposite ends with wedge faces 112. Thus, when the fastening bolts 93 and 94 and nuts 95 and 96 tighten the flanges 13, 14 of the anchoring means 11 and seat plates 91, 111 together, the bars 122 are firmly pinched between the flanges 99 of the seat plate 91 and the wedge faces 112 of the seat plate 111 to thereby secure the clothes drying device to the hand-rail.

The attachment means 90 and 110 enable the clothes drying device to be secured to the hand-rail at a desired or selected position thereon in a simple manner.

While several embodiments of the invention have been shown and described in detail, it will be understood that the same is for illustration purpose only and not to be taken as a definition of the invention, reference being had for the purpose to the appended claims.

What is claimed is:

1. A cantilever-type drying device comprising:

an anchoring member adapted to be secured to a supportive structure, said anchoring member having a cylindrical main body portion with a vertical bore therethrough and at least one longitudinal groove in the outer longitudinal surface of said cylindrical main body;

an upright cylindrical support shaft fitted into and having a portion extending above said vertical bore and axially rotatable therein, said extended portion having a vertical cutout portion in the cetner thereof in the axial direction and two aligned bores, transverse to said vertical bore, one bore through each portion of said shaft on either side of said cutout portion; and support arm means for supporting clothes rods and lines thereon pivotally connected inbetween said cutout portion of said extended portion of said vertical shaft, movable in the vertical direction, and engageable with said longitudinal groove in said main body portion, whereby said support arm means and said support shaft connected thereto are prevented from rotating in the horizontal direction when said support arm means engages said longitudinal groove.

2. A device as claimed in claim 1 wherein said support arm means is comprised of:

a rotatable upper base portion inbetween the sides of said cutout portion of said extended portion and having a hole therethrough aligned with the two transverse holes through said extended portion;

a stub shaft fitted through said aligned holes, whereby said upper base portion is pivotable therearound;

a lower base portion beneath said upper base portion having an engaging tongue adapted to engage said longitudinal groove in said main body portion; and an extended arm portion attached to both said upper and lower base portions and extending outward therefrom.

3. A device as claimed in claim 2, wherein said extended arm portion has a plurality of spaced hooks extending upward from the upper surface thereof.

4. A device as claimed in claim 1 further comprising:

attachment means fitted to said anchoring member for attaching said anchoring member between two spaced support rods, said attachment means comprised of:

a pair of seat plates bridging said spaced support rods, one on each side of said rods;

fastening bolts extending through said seat plates and said anchoring member; and nuts screwed onto the end of said fastening bolts, whereby tightening said nuts causes said seat plates to press against said support rods and hold said anchoring member thereagainst.

* * * * *